US011079170B2

(12) United States Patent
Xu et al.

(10) Patent No.: US 11,079,170 B2
(45) Date of Patent: Aug. 3, 2021

(54) REFRIGERATOR HAVING SLIDE RAIL CABLING MECHANISM

(71) Applicant: HAIER SMART HOME CO., LTD., Qingdao (CN)

(72) Inventors: Yihao Xu, Qingdao (CN); Bin Fei, Qingdao (CN); Dengqiang Li, Qingdao (CN); Xueli Cheng, Qingdao (CN)

(73) Assignee: HAIER SMART HOME CO., LTD., Qingdao (CN)

( * ) Notice: Subject to any disclaimer, the term of this patent is extended or adjusted under 35 U.S.C. 154(b) by 0 days.

(21) Appl. No.: 17/042,163

(22) PCT Filed: Sep. 10, 2019

(86) PCT No.: PCT/CN2019/105073

§ 371 (c)(1),
(2) Date: Sep. 27, 2020

(87) PCT Pub. No.: WO2020/134184

PCT Pub. Date: Jul. 2, 2020

(65) Prior Publication Data

US 2021/0018260 A1 Jan. 21, 2021

(30) Foreign Application Priority Data

Dec. 27, 2018 (CN) ..... 201811612927.5

(51) Int. Cl.
*F25D 25/02* (2006.01)
*F25D 23/02* (2006.01)

(52) U.S. Cl.
CPC ..... *F25D 25/025* (2013.01); *F25D 23/028* (2013.01); *F25D 23/021* (2013.01); *F25D 2323/02* (2013.01)

(58) Field of Classification Search
CPC .... F25D 25/025; F25D 23/028; F25D 23/021; F25D 2323/02
See application file for complete search history.

(56) References Cited

U.S. PATENT DOCUMENTS 8,291,816 B2 * 10/2012 Iwamoto ..... A47J 39/00 99/467
9,046,295 B2 * 6/2015 Han ..... H01R 25/006
(Continued)

FOREIGN PATENT DOCUMENTS

CN 105300021 A 2/2016
CN 106871529 A 6/2017
(Continued)

*Primary Examiner* — Kimberley S Wright
(74) *Attorney, Agent, or Firm* — Cheng-Ju Chiang

(57) ABSTRACT

A refrigerator having a slide rail cabling mechanism comprises a compartment provided with a front-facing opening and a drawer-type door. The compartment has a bottom wall, a rear wall, and two sidewalls. An electrical component is provided on the drawer-type door. The slide rail cabling mechanism comprises a cable for powering the electrical component, a first cabling box, and a second cabling box. A first receiving portion and a second receiving portion located below a drawer box are formed in the first cabling box. The cable has a fixed section fixed in the first receiving portion and a movable section extending from the fixed section to the second cabling box. The second receiving portion is used to receive part of the movable section. The second cabling box is formed with a fixed receiving section extending in the front-rear direction.

18 Claims, 5 Drawing Sheets

(56) References Cited

U.S. PATENT DOCUMENTS

| | | | | |
|---|---|---|---|---|
| 9,115,929 | B2 * | 8/2015 | Han | F25D 25/025 |
| 9,523,531 | B2 * | 12/2016 | Han | H01R 25/006 |
| 9,585,474 | B2 * | 3/2017 | Haltmeyer | F25D 23/067 |
| 10,674,822 | B1 * | 6/2020 | Koyama | G03G 15/80 |
| 10,733,816 | B2 * | 8/2020 | Hashemi | E05B 65/462 |
| 10,823,486 | B2 * | 11/2020 | Han | F25D 23/02 |
| 2009/0301312 | A1 * | 12/2009 | Iwamoto | A47J 39/00 99/357 |
| 2011/0181163 | A1 * | 7/2011 | Han | F25D 29/005 312/405 |
| 2015/0022072 | A1 * | 1/2015 | Haltmeyer | A47B 97/00 312/401 |
| 2015/0069899 | A1 * | 3/2015 | Han | F25D 23/02 312/404 |
| 2015/0323243 | A1 * | 11/2015 | Han | F25D 11/00 312/404 |
| 2016/0102904 | A1 * | 4/2016 | Han | F25D 25/025 312/404 |
| 2017/0024946 | A1 * | 1/2017 | Hashemi | G07C 9/00912 |
| 2018/0180349 | A1 * | 6/2018 | Han | H01R 25/006 |
| 2018/0315264 | A2 * | 11/2018 | Hashemi | G07C 9/00182 |

FOREIGN PATENT DOCUMENTS

| | | | | |
|---|---|---|---|---|
| CN | 108426415 | A | 8/2018 | |
| CN | 109028726 | A | 12/2018 | |
| CN | 109028727 | A | 12/2018 | |
| CN | 109780805 | A | 5/2019 | |
| CN | 109780806 | A | 5/2019 | |
| WO | WO-2019242234 | A1 * | 12/2019 | F25D 25/025 |

* cited by examiner

REFRIGERATOR HAVING SLIDE RAIL CABLING MECHANISM

CROSS REFERENCE TO RELATED APPLICATIONS

The present application is a 35 U.S.C. § 371 National Phase conversion of International (PCT) Patent Application No. PCT/CN2019/105073, filed on Sep. 10, 2019, which claims benefit of Chinese patent application No. 201811612927.5 filed on Dec. 27, 2018, the disclosure of which is incorporated by reference herein. The PCT International Patent Application was filed and published in Chinese.

TECHNICAL FIELD

The present invention relates to the technical field of refrigeration equipment, and particular to a refrigerator having a slide rail cabling mechanism.

BACKGROUND

In recent years, the consumer market proposes higher and higher requirements for aspects of refrigerator products such as volume, appearance and operational convenience. It is a widely-employed technical solution to dispose a display screen or other electrical components on a door of the refrigerator to enhance the appearance of the refrigerator and increase corresponding functions. Cabling is mostly arranged in a hinge shaft for conventional rotary-type refrigerator door bodies to achieve electrical power transmission on the door bodies; as for drawer-type door bodies, a cable needs to be disposed between the drawer-type door and the cabinet to achieve the power supply to the electrical components. Since the drawer-type door moves back and forth during the opening and closing, the cable is movably disposed. Furthermore, a gap between the drawer box and the cabinet of the refrigerator is small, the cable is liable to entangle with other components, wear even break, and cause failure.

In the industry is already disclosed a solution in which a linkage assembly is disposed between the cabinet of the refrigerator and the drawer-type door, and the cable is connected to the door from the side of the cabinet along the corresponding linkage assembly. However, the cable is subject to a large stress at a position where the linkage assembly itself is bent and deformed, and wear and failure might occur to the linkage assembly itself upon repeated operation, which affects the experience in operating the drawer-type door. In the industry is also disclosed a slide rail cabling mechanism in which a fixed frame and a support frame are disposed on an inner wall of the compartment and on a rear side of the door respectively, a guide hole is formed on the fixed frame, the cable extends between the fixed frame and the inner wall through the guide hole into the compartment, and then extends through a wire box fixed on the support frame towards the drawer-type door. It is still difficult that the slide rail cabling mechanism forms effective limitation and constraint of a movable portion of the cable. This portion of cable is still likely to interfere with the slide rail or other components, and is therefore pressed to wear, which affects the operation of the electrical compartments on the drawer-type door.

In view of this, it is necessary to provide a new refrigerator having a slide rail cabling mechanism.

SUMMARY

To achieve the above object, the present invention provides a refrigerator having a slide rail cabling mechanism, comprising a compartment opened forward and a drawer-type door which is movable back and forth to open or close the compartment, the compartment having a bottom wall, a rear wall and two sidewalls, the drawer-type door being provided with an electrical component, a support frame movably mounted on the sidewall in a front-rear direction being further disposed on a rear side of the drawer-type door, the support frame being used to support a drawer box; the slide rail cabling mechanism comprises a cable for powering the electrical component, a first cabling box fixed on an inner side of the compartment and a second cabling box fixed on the support frame; the first cabling box is formed with a first receiving portion and a second receiving portion below the drawer box, the cable having a fixed section fixed in the first receiving portion and a movable section extending from the fixed section towards the second cabling box, the second receiving portion being used to receive part of the movable section; the second cabling box is formed with a fixed receiving section extending in the front-rear direction.

Optionally, wherein both the first receiving portion and second receiving portion are disposed spaced apart from the bottom wall.

Optionally, wherein a partial area of the bottom wall is recessed downward to form a groove, and the first receiving portion and the second receiving portion are correspondingly disposed above the groove.

Optionally, wherein a front end and a rear end of the first cabling box are respectively formed with a first fixed portion and a second fixed portion, and the first receiving portion and the second receiving portion are both located between the first fixed portion and the second fixed portion in the front-rear direction.

Optionally, wherein the slide rail cabling mechanism further comprises a base fixed on the bottom wall, and the first fixed portion is fixed with the base.

Optionally, wherein the first fixed portion is pressed down on the base, and the first fixed portion is formed with a plurality of fixing ribs which are opposed to one another in a left-right direction and pressed against the surface of the base.

Optionally, wherein the base is formed with a mounting hole that is disposed backward and obliquely downward, and the first cabling box is provided with a fixing hole at a position corresponding to the mounting hole.

Optionally, wherein the slide rail cabling mechanism further comprises a rear connection box fixed on the rear wall, and the second fixed portion is fixed with the rear connection box.

Optionally, wherein a plurality of first fixing members for fixing the fixed section are provided in the first receiving portion.

Optionally, wherein the first receiving portion comprises a linear receiving space extending back and forth, and an arcuate receiving space located in front of the linear receiving space and communicated with the second receiving portion, and the second receiving portion is provided with a limiting member at an end adjacent to the arcuate receiving space.

Optionally, wherein the second cabling box is further formed with a guide section located in the rear of the fixed receiving section, and the guide section is formed with a guide surface extending backward and toward the inner side of the compartment in the left-right direction.

Optionally, wherein the second cabling box further has a mounting opening located between the fixed receiving section and the guide section, both ends of the cable are respectively provided with a first terminal and a second terminal, and at least one of both the first terminal and the second terminal may pass through the mounting opening.

Optionally, wherein the second cabling box is further formed with at least two snap-fitting portions which are spaced apart in the front-rear direction and snap-fitted with the support frame.

Optionally, wherein the fixed receiving section is provided with a plurality of second fixing members for restricting the movement of the cable.

Optionally, wherein the sliding rail cabling mechanism comprises a door support iron fixed on the rear side of the drawer-type door and fixed with the support frame, a connecting window is provided on the door support iron, and the slide rail cabling mechanism further comprises a front connection box detachably mounted on the connecting window.

Optionally, wherein a distance between the second cabling box and the second receiving portion is set to 15-20 times a diameter of the cable.

Optionally, wherein the fixed receiving section is located below the drawer box and not lower than the first cabling box in the vertical direction.

Optionally, wherein a sheath is circumferentially provided around at least a portion of the cable.

The present invention achieves the following advantageous effects: in the refrigerator of the present invention, the first receiving portion and the second receiving portion of the first cabling box are arranged below the drawer box, a portion of the movable section of the cable is received in the second receiving portion, and the other portion of the movable section is freely movable between the drawer box and the bottom wall, avoiding the cable from moving to between the drawer box and the sidewall and from being pressed to deform. Furthermore, as the first cabling box is disposed away from the support frame, it is possible to reduce the bending stress of the cable, better avoid the cable from excessive deformation and distortion and damages, and effectively ensure normal operation of the electrical component on the drawer-type door.

The rear end of the second cabling box is formed with the guide section having the guide surface, which can better limit the cable and avoid the cable from moving and being pressed to deform.

DETAILED DESCRIPTION

The present invention will be described in detail in conjunction with embodiments shown in the figures. However, these embodiments are not intended to limit the present invention. Structural, methodological or functional variations made by those having ordinary skill in the art according to these embodiments are all included in the extent of protection of the present invention.

Figure 1:
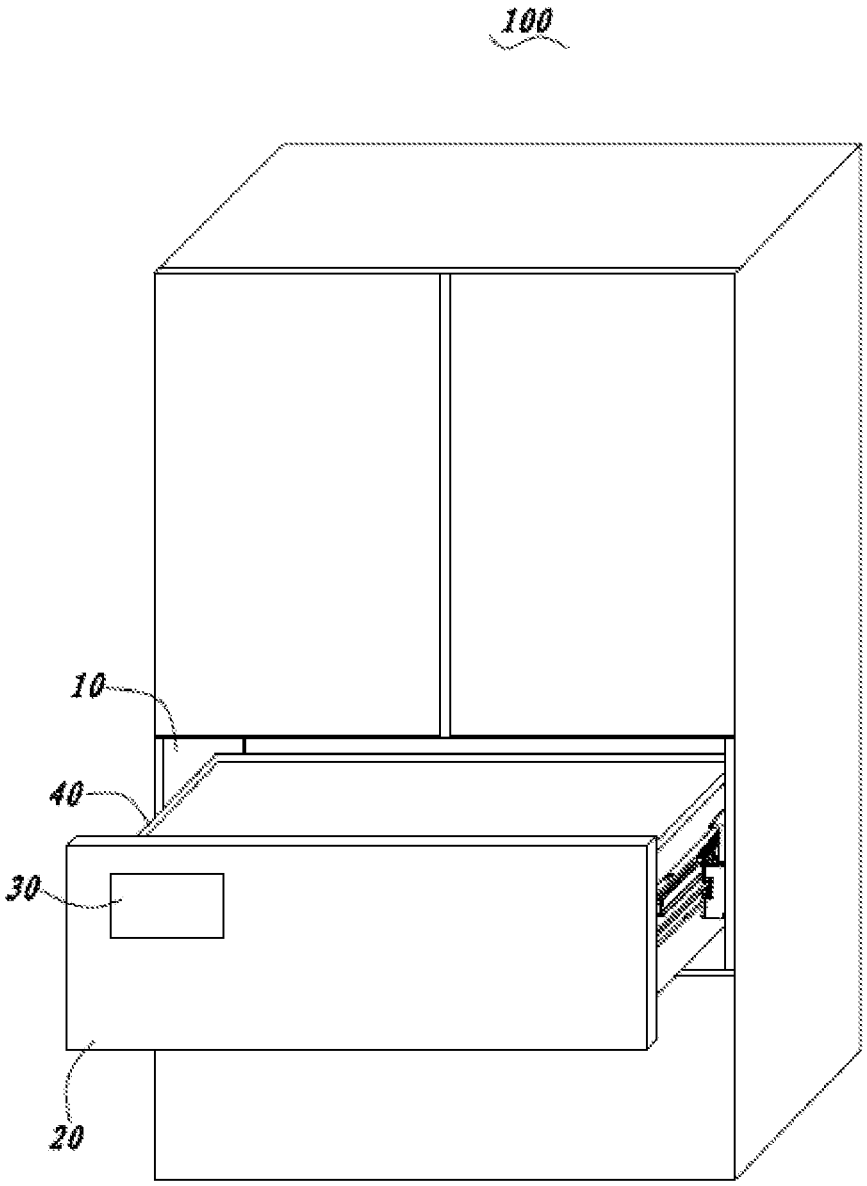
FIG. 1 is an overall schematic view of a refrigerator having a slide rail cabling mechanism according to the present invention.

Referring to FIG. 1, a refrigerator 100 according to the present invention comprises a compartment 10 opened forward and a drawer-type door 20 which is movable back and forth to open or close the compartment 10. The drawer-type door 20 is provided with an electrical component which may be a touch display screen 30; a drawer box 40 for storing items is provided at a rear side of the drawer-type door 20.

Figure 2:
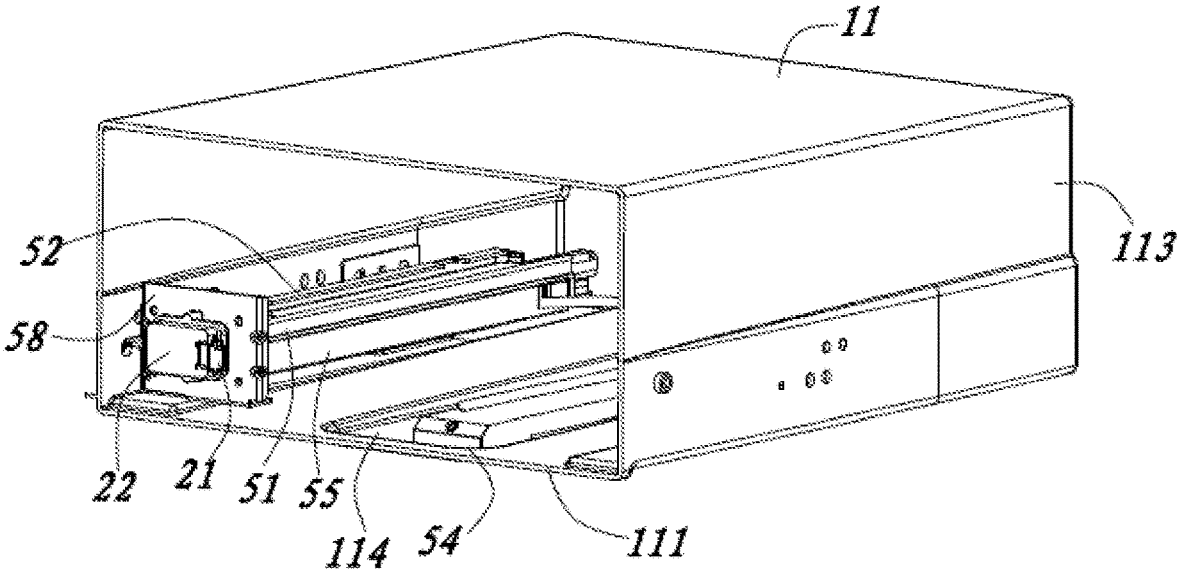
FIG. 2 is an assembly view of a liner and the slide rail cabling mechanism in the refrigerator according to the present invention.
Figure 3:
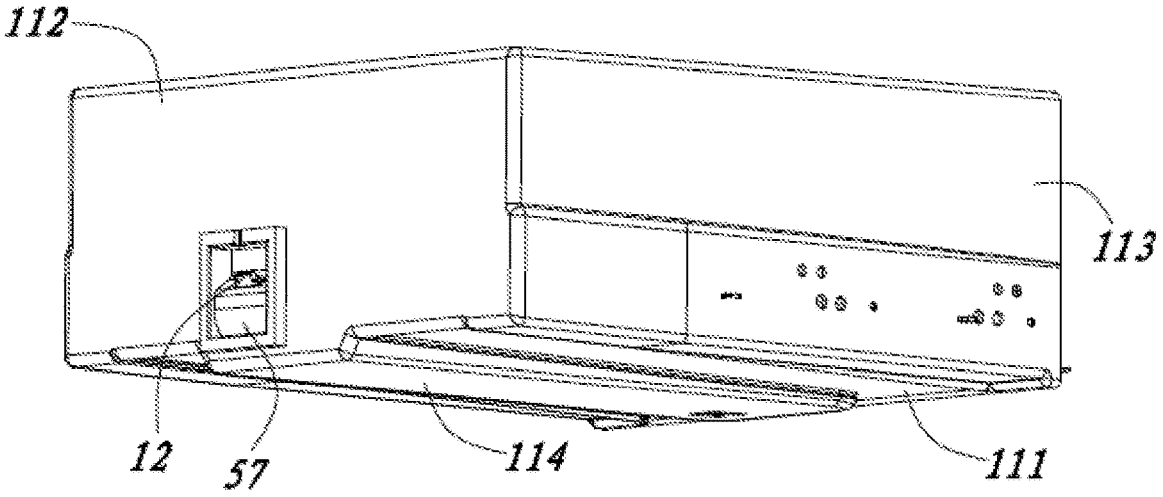
FIG. 3 is a structural schematic view of the liner and the slide rail cabling mechanism of FIG. 2 from another perspective.
Figure 4:
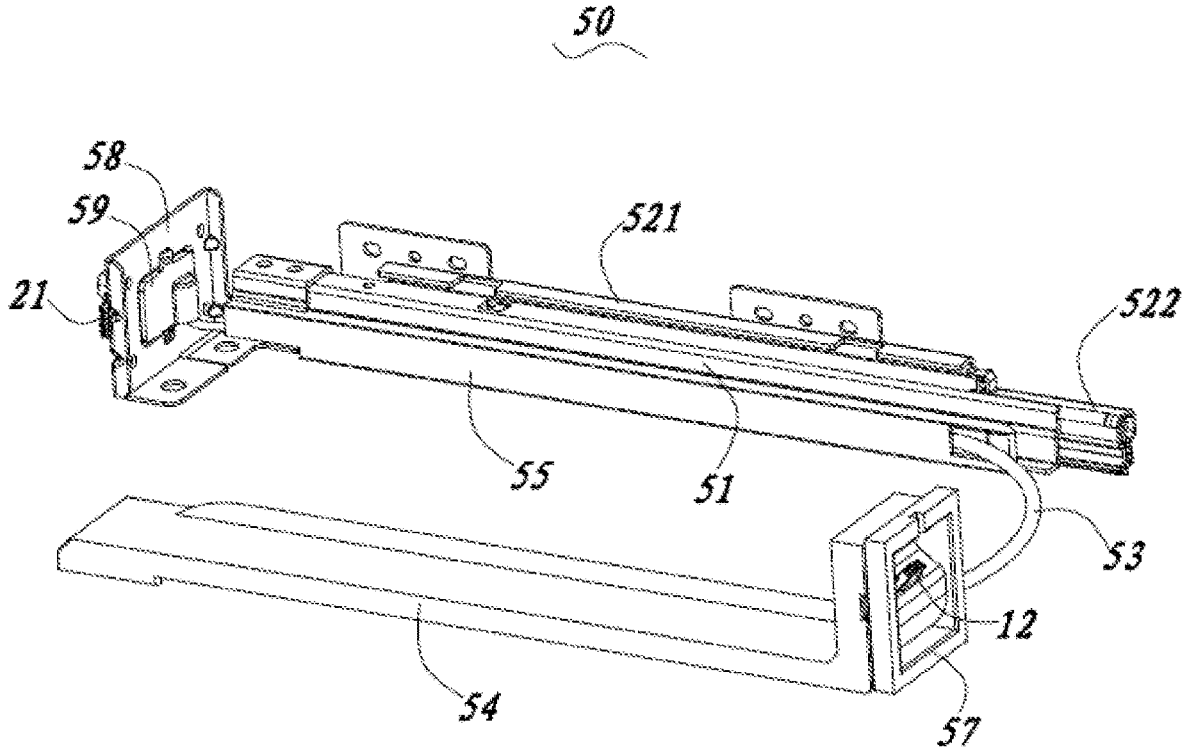
FIG. 4 is an assembly view of the slide rail cabling mechanism of the refrigerator according to the present invention.
Figure 5:
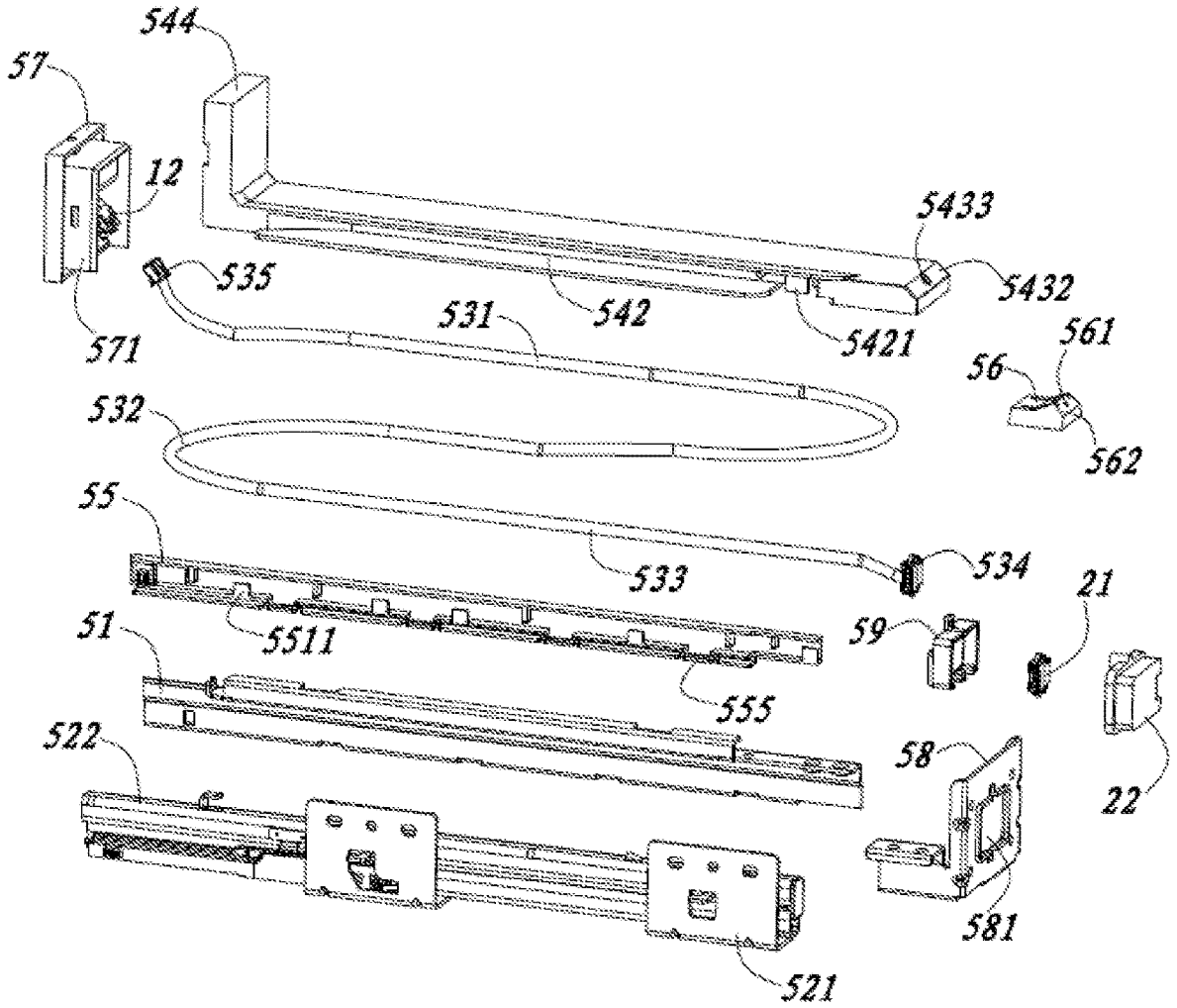
FIG. 5 is an exploded view of the slide rail cabling mechanism of the refrigerator according to the present invention.
Figure 6:
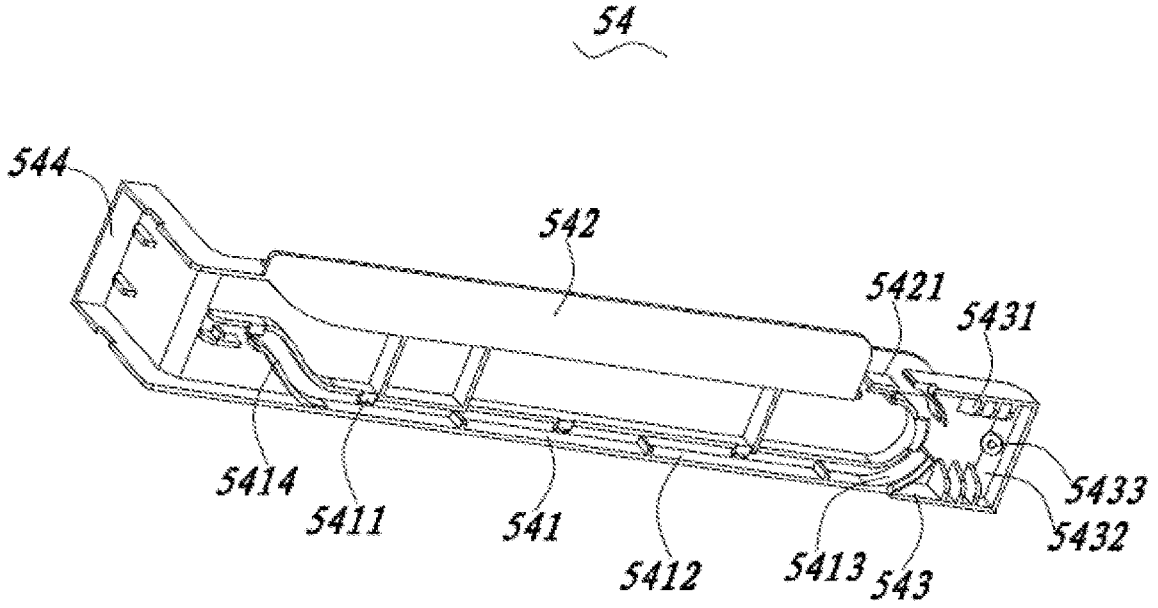
FIG. 6 is a structural schematic view of a first cabling box of the slide rail cabling mechanism of the refrigerator according to the present invention.
Figure 7:
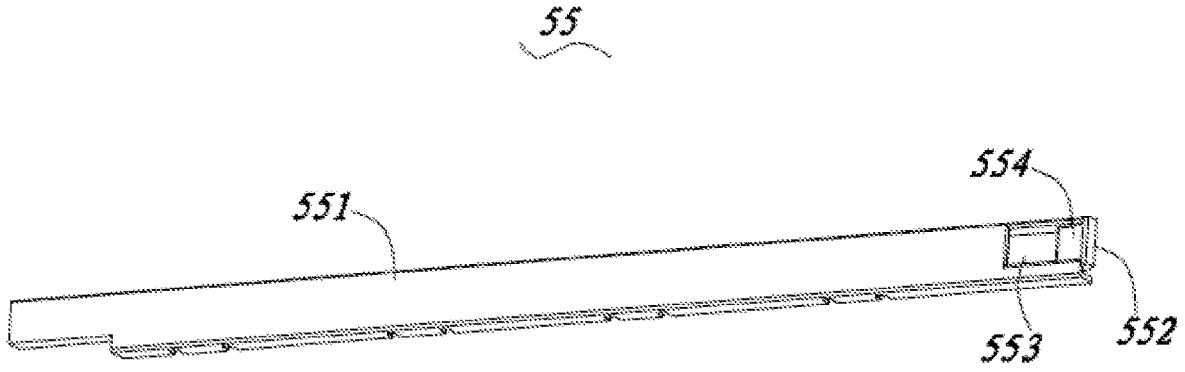
FIG. 7 is a structural schematic view of a second cabling box of the slide rail cabling mechanism of the refrigerator according to the present invention.

With reference to FIG. 2 and FIG. 3, in the compartment 10 is disposed a liner 11 opened ahead and configured to receive the drawer box 40, and the liner 11 has a bottom wall 111, a rear wall 112 and two sidewalls 113. Here, the bottom wall 111, the rear wall 112 and the two sidewalls of the liner 11 may be understood as the bottom wall, rear wall and sidewalls of the compartment 10.

Referring to FIG. 4 through FIG. 7, the refrigerator further comprises a slide rail cabling mechanism 50 which includes a support frame 51 and a slide assembly 52 fixed to the rear side of the door 20. The support frame 51 is mounted on the sidewall 113 movably in a front-rear direction, and the support frame 51 is used to support the drawer box 40. Specifically, the slide assembly 52 comprises fixed frames 521 oppositely disposed on the two sidewalls 113 and slide rails 522 mounted on the fixed frames 521, and the slide rails 522 are used to achieve sliding engagement of the support frame 51 and the fixed frame 521; the slide rail 522 is preferably a three-stage slide rail.

The slide rail cabling mechanism 50 further comprises a cable 53 for powering the touch display screen 30, a first cabling box 54 fixed on the inner side of the compartment and a second cabling box 55 fixed on the support frame 51. The first cabling box 54 is formed with a first receiving portion 541 and a second receiving portion 542 below the drawer box 40; the second cabling box 55 is formed with a fixed receiving section 551 extending in the front-rear direction and a guide section 552 located in the rear of the fixed receiving section 551. A distance between the second cabling box 55 and the second receiving portion 542 is set to 15-20 times a diameter of the cable 53 so that the cable 53 maintains a suitable curvature.

The cable 53 has a fixed section 531 fixed in the first receiving portion 541 and a movable section 532 extending from the fixed section 531 towards the second cabling box 55, and the second receiving portion 542 is used to receive part of the movable section 532; the cable 53 further comprises another fixed section 533 received in the fixed receiving section 551, and both ends of the cable 53 are respectively provided with a first terminal 534 and a second terminal 535. Correspondingly, the drawer-type door 20 is provided with a first connector 21 connected with the first terminal, and a second connector 12 connected with the second terminal 535 is disposed in the compartment 10. In addition, a sheath (not shown) is circumferentially provided around at least a portion of the cable 53 to reinforce the structural strength of the cable 53. The sheath may be made of a material such as a wire mesh or resin, and the sheath is preferably disposed on the outer circumference of the movable section 532 of the cable 53.

In addition, both the first receiving portion 541 and second receiving portion 542 are disposed spaced apart from the bottom wall 113 to avoid the erosion that might be caused by the condensate water staying on the bottom wall 113 to the cable 53, and prevent occurrence of abnormities such as electric leakage. In the present embodiment, a partial area of the bottom wall 113 is recessed downward to form a groove 114, and the first receiving portion 541 and the second receiving portion 542 are correspondingly disposed above the groove 114 and spaced apart from the bottom of the groove 114. The setting of the groove 114 reduces occupation of the space between the bottom wall 111 and the drawer box 40 by the first cabling box 54, and then may appropriately reduce the bottom wall 111 and the drawer box 40. Furthermore, the second receiving portion 542 is preferably not lower than the position of the opening of the groove 114 in height to avoid wear of the cable 53.

A front end and a rear end of the first cabling box 54 are respectively formed with a first fixed portion 543 and a second fixed portion 544, and the first receiving portion 541 and the second receiving portion 542 are both located between the first fixed portion 543 and the second fixed portion 544 in a front-rear direction. The slide rail cabling mechanism 50 further comprises a base 56 fixed on the bottom wall 111 and a rear connection box 57 fixed on the rear wall 112, and the first fixed portion 543 is fixed with the base 56; the second fixed portion 544 is fixed with the rear connection box 57.

Specifically, the base 56 may be preset at a given position of the bottom wall 111, and then fixed by foaming, or formed on the liner 11 and then fixedly mounted on the bottom wall 111. The base 56 is preferably disposed and mounted in the groove 114, and the base 56 is disposed with a gap with the periphery of the groove 114. The first fixed portion 543 is pressed down on the base 56, and opened downward so that the base 56 is completely received on the inner side of the first fixed portion 543. The first fixed portion 543 is formed with a plurality of fixing ribs 5431 which are opposed to one another in a left-right direction and pressed against the surface of the base 56. The fixing ribs 5431 arranged opposed to one another in the left-right direction gradually narrow towards the center in an up-down direction to facilitate the installation of the first fixed portion 543.

In order to achieve stable installation of the first fixed portion 543, the base 56 is also formed with a mounting hole 561 that is disposed backward and obliquely downward. A mounting surface 562 of the base 56 where the mounting hole 561 is provided is disposed forward and obliquely upward. The first fixed portion 543 of the first cabling box 54 is formed with a fixing surface 5432 abutting against the mounting surface 562, and the fixing surface 5432 is provided with a fixing hole 5433 at a position corresponding to the mounting hole 561, and the affixation and mounting of the first fixed portion 543 and the base 56 may be achieved by a screw (not shown). Here, the mounting hole 561 and the fixing hole 5433 are arranged obliquely, which facilitates on-site assembly, and when the space in the compartment 10 is small, the mounting operation is not affected.

The rear connection box 57 may also be pre-fixed on the rear wall 112. The rear connection box 57 has a docking portion 571 protruding forward. The docking portion 571 is configured as a rectangular frame shape opened downward to prevent the water vapor on the upper side and both sides from entering the interior of the rear connection box 57. The second fixing portion 544 is snap-fitted on the docking portion 571 to realize the fixing of the rear end of the first cabling box 54. In other embodiments of the present invention, the rear connection box 57 may also be directly fixed on the bottom wall 111, so that the second connector 12 is exposed toward the interior of the compartment 10 to connect with the cable 53.

A plurality of first fixing members 5411 for fixing the fixed section 531 are provided in the first receiving portion 541. Specifically, the first fixing members 5411 are preferably set as plate-shaped or hook-shaped protrusions integrally formed with the first receiving portion 541, and the protrusions are arranged at different positions to limit the movement of the fixed section 531 in a vertical direction and a horizontal direction. Here, the first receiving portion 541 comprises a linear receiving space 5412 extending back and forth, and an arcuate receiving space 5413 located in front of the linear receiving space 5412 and communicated with the second receiving portion 542. The arcuate receiving space 5413 is preferably set in a semicircular shape, that is, the cable 53 is bent 180° from front to back and then enters the second receiving portion 542. The second receiving portion 542 is provided with a limiting member 5421 at an end adjacent to the arcuate receiving space 5413 to avoid the movement of the cable 53; a side of the rear end of the second receiving portion 542 facing the second cabling box 55 is also set as an arcuate surface to better limit the bending direction of the cable 53 when the drawer box is retracted into the compartment 10. In addition, the first receiving portion 541 further comprises a bent receiving space 5414 located in rear of the linear receiving space 5412, so that the rear end of the fixed section 531 is located exactly at an intermediate position of the first cabling box 54 in the left-right direction to facilitate assembling and connection of the cable 53 and the compartment 10.

The second cabling box 55 further has a mounting opening 553 located between the fixed receiving section 551 and the guide section 552. The fixed receiving section 551 is provided with a plurality of second fixing members 5511 for restricting the movement of the cable 53. The second fixing members 5511 are preferably configured as plate-shaped or hook-shaped protrusions integrally formed inside the fixed receiving section 551, and the protrusions are arranged at different positions to limit the movement of a corresponding portion of the cable 53 in a vertical direction and a horizontal direction. The fixed receiving section 551 is located below the drawer box 40 and not lower than the first cabling box 54 in the vertical direction. Preferably, the fixed receiving section 551 is slightly higher than the second receiving portion 542, thereby avoiding frictional damage between the movable section 532 of the cable 53 and the bottom wall 111.

The guide section 552 and the fixed receiving section 551 are integrally formed, and needn't be mounted and fixed together again on the spot. The guide section 552 is formed with a guide surface 554 extending backward and toward the inner side of the compartment 10 in the left-right direction. The guide surface 554 is preferably an arcuate surface. At least one of the first terminal 534 and the second terminal 535 may pass through the mounting opening 553 to facilitate the mounting of the cable 53. The second cabling box 55 is further formed with at least two snap-fitting portions 555 which are spaced apart in the front-rear direction and snap-fitted with the support frame 51 to achieve the fixing and mounting of the second cabling box 55.

In addition, the sliding rail cabling mechanism 50 comprises a door support iron 58 fixed on the rear side of the drawer-type door 20 and fixed with the support frame 51, a connecting window 581 is provided on the door support iron 58, and the slide rail cabling mechanism 50 further comprises a front connection box 59 detachably mounted on the connecting window 581.

In summary, in the refrigerator 100 of the present invention, the first receiving portion 541 and the second receiving portion 542 of the first cabling box 54 are arranged below the drawer box 40, a portion of the movable section 532 of the cable 53 is received in the second receiving portion 542, the other portion of the movable section 532 is freely movable between the drawer box 40 and the bottom wall 111, the guide surface 554 formed by the guide section 552 at the rear end of the second cabling box 55 also helps the movable end 532 to maintain a suitable state, avoiding the cable 53 from moving to between the drawer box 40 and the sidewall 113 and from being pressed to deform. The first cabling box 54 is disposed away from the support frame 51, thereby reducing the bending stress of the cable 53, better avoiding the cable 53 from excessive deformation and distortion and damages, and effectively ensuring normal operation of the electrical component on the drawer-type door 20.

It should be understood that although the description is described according to the embodiments, not every embodiment only includes one independent technical solution, that such a description manner is only for the sake of clarity, that those skilled in the art should take the description as an integral part, and that the technical solutions in the embodiments may be suitably combined to form other embodiments understandable by those skilled in the art.

The detailed descriptions set forth above are merely specific illustrations of feasible embodiments of the present invention, and are not intended to limit the scope of protection of the present invention. All equivalent embodiments or modifications that do not depart from the art spirit of the present invention should fall within the scope of protection of the present invention.

What is claimed is:

1. A refrigerator having a slide rail cabling mechanism, comprising a compartment opened forward and a drawer-type door which is movable back and forth to open or close the compartment, the compartment having a bottom wall, a rear wall and two sidewalls, the drawer-type door being provided with an electrical component, a support frame movably mounted on the sidewall in a front-rear direction being further disposed on a rear side of the drawer-type door, the support frame being used to support a drawer box, wherein the slide rail cabling mechanism comprises a cable for powering the electrical component, a first cabling box fixed on an inner side of the compartment and a second cabling box fixed on the support frame; the first cabling box is formed with a first receiving portion and a second receiving portion below the drawer box, the cable having a fixed section fixed in the first receiving portion and a movable section extending from the fixed section towards the second cabling box, the second receiving portion being used to receive part of the movable section; the second cabling box is formed with a fixed receiving section extending in the front-rear direction.

2. The refrigerator according to claim 1, wherein both the first receiving portion and second receiving portion are disposed spaced apart from the bottom wall.

3. The refrigerator according to claim 2, wherein a partial area of the bottom wall is recessed downward to form a groove, and the first receiving portion and the second receiving portion are correspondingly disposed above the groove.

4. The refrigerator according to claim 1, wherein a front end and a rear end of the first cabling box are respectively formed with a first fixed portion and a second fixed portion, and the first receiving portion and the second receiving portion are both located between the first fixed portion and the second fixed portion in the front-rear direction.

5. The refrigerator according to claim 4, wherein the slide rail cabling mechanism further comprises a base fixed on the bottom wall, and the first fixed portion is fixed with the base.

6. The refrigerator according to claim 5, wherein the first fixed portion is pressed down on the base, and the first fixed portion is formed with a plurality of fixing ribs which are opposed to one another in a left-right direction and pressed against the surface of the base.

7. The refrigerator according to claim 5, wherein the base is formed with a mounting hole that is disposed backward and obliquely downward, and the first cabling box is provided with a fixing hole at a position corresponding to the mounting hole.

8. The refrigerator according to claim 4, wherein the slide rail cabling mechanism further comprises a rear connection box fixed on the rear wall, and the second fixed portion is fixed with the rear connection box.

9. The refrigerator according to claim 1, wherein a plurality of first fixing members for fixing the fixed section are provided in the first receiving portion.

10. The refrigerator according to claim 1, wherein the first receiving portion comprises a linear receiving space extending back and forth, and an arcuate receiving space located in front of the linear receiving space and communicated with the second receiving portion, and the second receiving portion is provided with a limiting member at an end adjacent to the arcuate receiving space.

11. The refrigerator according to claim 1, wherein the second cabling box is further formed with a guide section located in the rear of the fixed receiving section, and the guide section is formed with a guide surface extending backward and toward the inner side of the compartment in the left-right direction.

12. The refrigerator according to claim 11, wherein the second cabling box further has a mounting opening located between the fixed receiving section and the guide section, both ends of the cable are respectively provided with a first terminal and a second terminal, and at least one of both the first terminal and the second terminal may pass through the mounting opening.

13. The refrigerator according to claim 1, wherein the second cabling box is further formed with at least two snap-fitting portions which are spaced apart in the front-rear direction and snap-fitted with the support frame.

14. The refrigerator according to claim 1, wherein the fixed receiving section is provided with a plurality of second fixing members for restricting the movement of the cable.

15. The refrigerator according to claim 1, wherein the sliding rail cabling mechanism comprises a door support iron fixed on the rear side of the drawer-type door and fixed with the support frame, a connecting window is provided on the door support iron, and the slide rail cabling mechanism further comprises a front connection box detachably mounted on the connecting window.

16. The refrigerator according to claim 1, wherein a distance between the second cabling box and the second receiving portion is set to 15-20 times a diameter of the cable.

17. The refrigerator according to claim 1, wherein the fixed receiving section is located below the drawer box and not lower than the first cabling box in the vertical direction.

18. The refrigerator according to claim 1, wherein a sheath is circumferentially provided around at least a portion of the cable.

* * * * *